United States Patent [19]

Van Sloun

[11] Patent Number: 4,811,470

[45] Date of Patent: Mar. 14, 1989

[54] SAFETY CLIP WITH CONTROLLED RELEASE FORCE

[75] Inventor: Peter H. Van Sloun, Hopkins, Minn.

[73] Assignee: Honeywell Inc., Minneapolis, Minn.

[21] Appl. No.: 78,331

[22] Filed: Jul. 27, 1987

[51] Int. Cl.[4] ..... F42C 15/20

[52] U.S. Cl. ..... 24/453; 24/573; 89/1.55; 102/261

[58] Field of Search ..... 24/161 R, 453, 543, 24/563, 67 R, 67.9, 67.11; 102/261, 382; 89/1.55

[56] References Cited

U.S. PATENT DOCUMENTS

| | | | |
|---|---|---|---|
| 148,390 | 3/1874 | Tappan | 24/161 R |
| 661,281 | 11/1900 | Urbach et al. | 24/161 R |
| 1,004,324 | 9/1911 | Wickman et al. | 24/161 R |
| 1,028,784 | 6/1912 | Raupach | 24/161 R |
| 1,192,898 | 8/1916 | Houston | 24/161 R |
| 1,609,041 | 11/1926 | Pauker | 24/67 R |
| 2,155,987 | 4/1939 | Assaf | 24/161 R |
| 2,273,368 | 2/1942 | Mumford | 24/161 R |
| 3,434,421 | 3/1969 | Berlin et al. | 102/261 |
| 3,760,682 | 9/1973 | Dexter | 89/1.55 |

*Primary Examiner*—Victor N. Sakran

*Attorney, Agent, or Firm*—E. W. Hughes; R. W. Jensen

[57] ABSTRACT

A safety clip (20) for an ordnance munitions device (10) is fabricated from a wire of resilient material. The clip includes a straight leg (22) having a free locking end (24), an attachment loop (26) carrying a pull ring (27), a back portion (28) having at least one spring element (32), and a closed loop (30) at the terminal end of the back portion (28) for receiving the free locking end (24) of the straight leg (22). The free end (24) extends beyond and through the closed loop (30), and may be extracted from the closed loop (30) essentially by means of a straight, axial pulling force of predetermined magnitude exerted on the pull ring.

7 Claims, 1 Drawing Sheet

SAFETY CLIP WITH CONTROLLED RELEASE FORCE

STATEMENT OF GOVERNMENT INTEREST

The Government has rights in this invention pursuant to Contract No. DAAK10-84-C-0239, awarded by the Department of the Army.

BACKGROUND OF THE INVENTION

1. Field of the Invention

This invention relates in general to safety clips or pins and, more particularly, to a safety clip for preventing accidental detonation of an ordnance munition device.

2. Description of the Prior Art

Most ordnance munition devices require a safety clip or safety pin of some sort which prevents accidental detonation of the device and which is manually or remotely removed prior to its final use. One well recognized such use is the safety pin on a standard hand grenade. More sophisticated, aircraft delivered type weapons have "remove before flight" pins which are structurally similar to the hand grenade pins, but which are removed remotely by means of an arming wire connected to an electrical solenoid.

The standard type of hand grenade safety pin comprises a cotter pin of relatively soft, ductile material which is bent after insertion through a fixed flange on the grenade's dentonator assembly. It is then rebent back into a straight position during withdrawal from the flange. Thus, the force required to remove the pin includes both an axial component for overcoming the friction exerted by the flange on the pin and a bending component for straightening the pin.

Other types of safety clips have been used which resemble conventional clothing type safety pins having one straight, free end and some type of catch means at the other end for retaining the straight end in a locked position. The force required to remove this type of clip includes both a squeezing component for releasing the straight end from the catch means and an axial component for overcoming friction.

The conventional cotter and clothing type safety pins suffer from a number of drawbacks. One drawback is that the metals typically used in such pins are often unable to withstand the rough, and sometimes careless handling and large variety of high impact forces to which munition devices are subjected during combat or training situations. The inherent weakness of the metals is compounded still farther by the bending stresses and deformation which are introduced while latching the pin in the device. Thus, the pins are prone to breaking and other types of failure, which can cause a munitions device to become inoperative or to detonate prematurely.

Another drawback of prior art safety pins or clips is that the amount of force required to withdraw the pins tends to vary widely from case to case. Two pins which are identical in structure, dimension, and materials may still require different removal forces due to such factors as differences in the bending stresses and the amount of permanent deformation which was introduced during latching, and the number of times which the pins may have been reused during training exercises. This lack of reproducibility of results is undesirable, since any deviation from normal could result in the pin releasing too soon or not releasing at all, which would in either case lead to hazardous conditions. Reproducibility is also important in the case of electrically armed devices since excessive dynamic loads on the arming wire can result in damage to the arming solenoid.

Therefore, a need exists for a new and improved ordnance munition safety clip which overcomes some of the problems and shortcomings of the prior art.

BRIEF SUMMARY OF THE INVENTION

In accordance with the present invention, an ordnance munition safety clip is provided with an improved design for controlling the release force.

The clip comprises a spring steel wire configured with one straight leg having a free locking end, an attachment loop formed opposite the free end for attaching a pull ring, and a roughly U-shaped back portion terminating in a closed loop for receiving the free end when the clip is locked. One or more spring elements such as coils or zig-zags are formed in the back portion for opposing the release force during extraction.

A typical use for the clip would be to fasten a removable member of an ordnance munitions device to a fixed base member of the same device. Both the removable member and the base are provided with apertured tabs through which the free locking end of the clip passes. To lock the two members together, it is simply necessary to position the clip so that the U-shaped back portion encompasses the apertured tabs, and then to insert the free end of the straight leg through the closed loop of the back portion.

To unlock the members, it is necessary to exert an axial force by pulling on the pull ring attached to the attachment loop of the clip, stressing the spring elements in the back portion of the clip. Once sufficient force has been exerted to extract the free end of the clip from the closed loop, the back portion springs away from the tabs of the munitions device to give the straight leg a free, crisp and clean exit.

Since the design of the clip is such that friction forces during extraction are negligible, the pull force is determined almost solely by the spring constant of the clip, which is a function of the wire diameter and material, the number and size of the spring elements, and the length of the portion of the straight leg which protrudes through the closed end loop of the back portion. By selecting these parameters such that the release force is well below the yield limit of the clip, the designer can ensure that no permanent metal deformation will occur. Thus, each clip can be reused indefinitely, for instance during training exercises, with substantially repeatable results.

Accordingly, it is an object of this invention to provide an improved ordnance munitions safety clip which is releasable essentially only by means of an axial pulling force of predetermined magnitude.

Another object of the invention is to provide an ordnance munitions safety clip capable of indefinite reuse without permanent deformation and with substantially repeatable results.

Another object of the invention is to design an ordnance munitions safety clip for clean springy withdrawal action in which friction forces play a negligible role.

The foregoing and other objects of the present invention, as well as the invention itself, may be more fully understood from the following description when read in conjunction with the accompanying drawings.

DETAILED DESCRIPTION OF THE INVENTION

Figure 2:
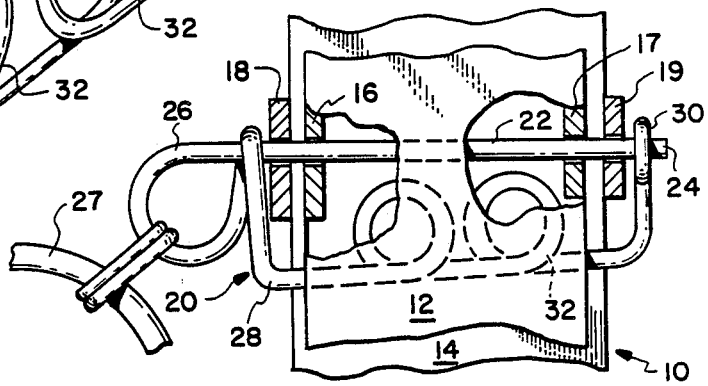
FIG. 2 is a front view of the safety clip locking a movable member of an ordnance munitions device to a fixed base member.

Referring more particularly to the drawings, FIG. 2 shows a portion of an ordnance munitions device 10 comprising a removable member 12, and a fixed base member 14. The removable member 12 which includes a pair of apertured tabs 16, 17 aligned with corresponding apertured tabs 18, 19 on the fixed base member 14, is locked within the base member 14 by means of the safety clip 20 of the present invention.

Figure 1:
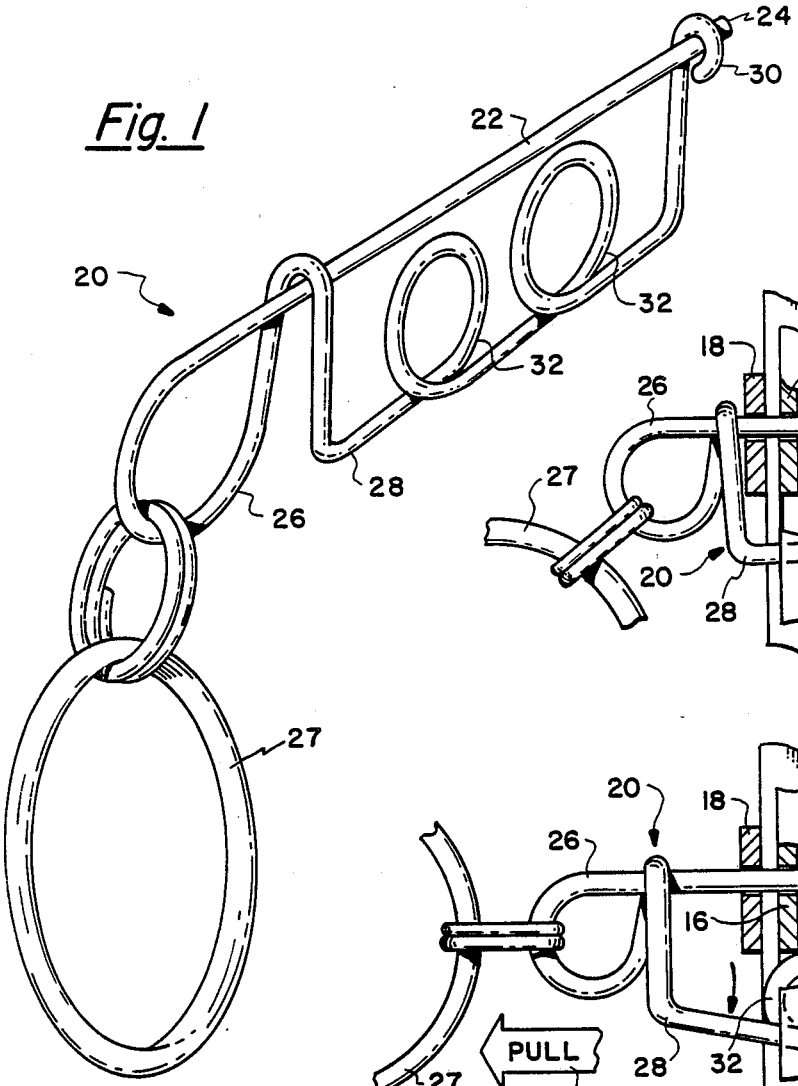
FIG. 1 is a perspective view of the safety clip according to the present invention.
Figure 3:
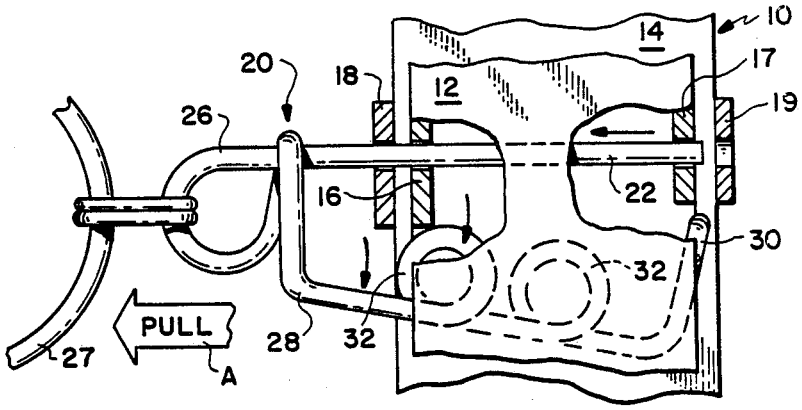
FIG. 3 is a front view of the safety clip being withdrawn from the ordnance munitions device.
Figure 4:
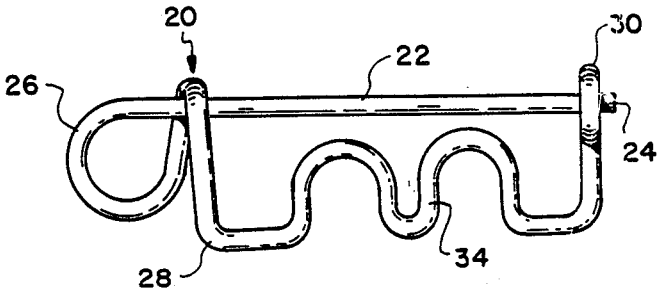
FIG. 4 is a front view of an alternative embodiment of the safety clip.

The safety clip 20 comprises a wire of high strength resilient material such as spring steel which is configured with one straight leg 22 having a free locking end 24, an attachment loop 26 formed opposite the free end 24 for attaching a pull ring 27, and a roughly U-shaped back portion 28 terminating in a closed loop portion 30 for receiving the free end 24 when the clip is locked. One or more spring elements, which may be configured as circular coils 32 as shown in FIGS. 1—3, or as undulating curves 34 as shown in FIG. 4, are formed in the central area of the back portion 28 for opposing the release force when clip 20 is extracted.

To lock the removable member 12 to the fixed base member 14 of the munitions ordnance device, it is simply necessary to insert the free locking end 24 of the clip 20 through the aligned apertures in the tabs 18, 16, 17 and 19, with the U-shaped back portion 28 of the clip 20 encompassing the tabs. Then, the closed loop 30 of the back portion 28 should be placed over the free end 24 of the clip 20.

Once the clip 20 has been fastened in this manner, it can essentially only be released by means of an axial pulling force of predetermined magnitude exerted on the pull ring 27, in the direction of arrow A. This pulling force loads the spring elements 32 or 34 to extract the end 24 from the loop 30, which causes the back portion 28 of the clip 20 to spring away from the apertured tabs 16, 17, 18, 19 of the munitions device, giving the straight leg 22 a clean, crisp exit.

Since the design of the clip is such that friction forces during extraction are negligible, the amount of pull force required to release it is determined almost solely by the spring constant, which is a function of the wire diameter, the number and size of the spring elements, the length of the portion of locking end 24 of the straight leg 22 which protrudes through the closed end loop 30 of the back portion 28 and the type of metal from which the wire is fabricated. By appropriate selection of these parameters, the designer can tailor the release force of the pin for different uses. For instance, for aircraft delivered weapons having electrical arming solenoids, a relatively high spring constant may be desired, while a lower spring constant would be appropriate for manually removable pins for use in hand grenades and the like. Clips with still lower release force could be designed for possible civilian applications such as in fire extinguishers. In any application, the release force must be well below the yield limit of the clip in order to prevent permanent metal deformation. This will ensure that the clip can be reused indefinitely during training exercises and the like, with substantially repeatable results.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. In combination:

a safety clip (20);

a movable member (12); and a fixed member (14);

said movable member and said fixed member including means forming pairs of aligned apertures (16, 18-17, 19), the pairs of means forming aligned apertures being spaced apart a predetermined distance;

said safety clip (20) being made of resilient wire configured to have a substantially straight leg (22), said straight leg (22) extending from an attachment loop (26) to a free locking end (24), said straight leg (22) being inserted through the means forming apertures (16, 18-17, 19), with free locking end (24) extending beyond the means forming apertures (16, 18-17, 19) of movable and fixed members (12,14), a substantially U-shaped back portion (28) extending from attachment loop (26) to a closed loop (30) through which free locking end (24) of straight leg (22) is inserted, said back portion (28) encompassing said means forming pairs of aligned apertures (16, 18-17, 19); and at least one spring element (32) being formed in back portion (28); whereby, safety clip (20) can be removed from the aligned pairs of means forming apertures (16, 18-17, 19) by a predetermined force applied to attachment loop (26) in a direction substantially parallel to the apertures of the means forming apertures (16, 18-17, 19) of fixed member (14) and movable member (12).

2. The combination of claim 1 further comprising a pull ring (22) secured to attachment loop (26).

3. The combination of claim 2 in which the resilient wire is made of spring steel.

4. In combination:

a safety clip (20) having a closed position;

a removable member (12);

a fixed base member (14);

said removable member (12) and said fixed base member (14) having means forming pairs (16, 17-18, 19) of aligned apertures, said means forming pairs of aligned apertures (16, 17-18, 19) being spaced apart a predetermined distance;

said safety clip (20) being made of spring steel wire configured to have a straight portion (22) extending from an attachment loop (26) to a free locking end (24), said straight portion (22) extending through the means forming aligned apertures (16, 18-17, 19), a back portion (28) extending from attachment loop (26) to a closed loop (30) formed at the free end of back portion (28), said back portion encompassing the means forming aligned apertures (16, 18-17, 19), the free locking end (24) of straight portion (22) extending through closed loop (30) when clip (20) is in its closed position; and a pull ring (27) attached to attachment loop 26, said safety clip 20, when closed being extractable from the means forming aligned apertures (16, 18-17, 19) essentially only by means of a force of predetermined magnitude applied to pull ring (27) in a direction substantially parallel to the apertures of the means forming aligned apertures (16, 18-17, 19).

5. In an ordnance munitions device (10) having a movable member (12) and a fixed base member (14), each of said members including a pair of spaced apart apertured tabs (16, 17-18, 19), the aperture tabs (16, 17) of movable member (12) being located inwardly of the apertured tabs (18, 19) of fixed base member (14) with the apertures thereof being aligned, the improvements comprising:

a safety clip (20) made from a single length of spring steel wire configured to have a straight leg portion (22) extending from an attachment loop (26) to a free locking end (24), said straight portion (22) extending through the apertures of the spaced apart apertured tabs (16, 17) of movable member (12) and the apertures of the apertured tabs (18, 19) of fixed base member (14), a substantially U-shaped back portion (28) extending from attachment loop (26) to a closed loop (30) formed at the free end of back portion (28), said back portion (28) encompassing tabs (18, 19) of fixed base member (14), at least one spring element (32) formed in a part of back portion (28) substantially parallel to straight portion (22) when clip (20) is closed, said straight leg portion extending through and beyond closed loop (30) of back portion (22) when clip (20) is closed and munitions device (20) is safe; and a pull ring (27) secured to attachment loop (26), said safety clip (20) being removable from the apertures of apertured tabs (16, 17-18, 19) of device (10) by a force applied to attachment loop (26) by pull ring (27) in a direction substantially parallel to straight leg portion (22) and in a direction away from free locking end (24) of straight leg portion (22), the magnitude of the force being determined by the characteristics of the spring steel wire, the number and size of the spring elements and the length beyond closed loop (30), free locking end (24) extends when clip (20) is closed.

6. In an ordnance munitions device as defined in claim 5 in which a spring element comprises one circular coil (32).

7. In an ordnance munitions device as defined in claim 6 in which a spring element comprises an undulating curve (34).

* * * * *